United States Patent [19]

Igarashi

[11] Patent Number: 4,725,793

[45] Date of Patent: Feb. 16, 1988

[54] WAVEGUIDE-MICROSTRIP LINE CONVERTER

[75] Inventor: Sadao Igarashi, Soma, Japan

[73] Assignee: Alps Electric Co., Ltd., Tokyo, Japan

[21] Appl. No.: 911,393

[22] Filed: Sep. 25, 1986

[30] Foreign Application Priority Data

Sep. 30, 1985 [JP] Japan ..... 60-150552[U]

[51] Int. Cl.[4] ..... H01P 5/107

[52] U.S. Cl. ..... 333/26; 333/208; 333/239

[58] Field of Search ..... 333/21 R, 26, 33, 236, 333/238, 239, 248, 99 R

[56] References Cited

U.S. PATENT DOCUMENTS

| | | | |
|---|---|---|---|
| 3,265,995 | 8/1966 | Hamasaki | 333/26 X |
| 3,577,105 | 5/1971 | Jones, Jr. | 333/239 |
| 3,626,335 | 12/1971 | Hord et al. | 333/21 R X |
| 3,768,048 | 10/1973 | Jones, Jr. et al. | 333/238 |
| 4,280,112 | 7/1981 | Eisenhart . | |
| 4,349,790 | 9/1982 | Landry . | |

*Primary Examiner*—Paul Gensler
*Attorney, Agent, or Firm*—Guy W. Shoup

[57] ABSTRACT

A waveguide-microstrip line converter for mode conversion in transmitting signals from a waveguide to a microstrip line or in the reverse, which comprises a dielectric body, a probe formed integrally with and within the dielectric body, and a conductive layer formed over the surface of the dielectric body excluding a surface to be brought into contact with a waveguide and an area surrounding the connecting part of the probe. The conductive layer is formed over the entire surface of the dielectric body, and then part of the conductive layer is removed by etching to provide the uncoated surface to be brought into contact with the waveguide and the probe. Thus the probe is continuous with the conductive layer and is an integral part of the dielectric body, so that the performance of the probe is unaffected by vibration and the high frequency resistance across the short-circuit waveguide is reduced to reduce signal transmission loss.

1 Claim, 4 Drawing Figures

WAVEGUIDE-MICROSTRIP LINE CONVERTER

BACKGROUND OF THE INVENTION

1. Field of the Invention

The present invention relates to a waveguide-microstrip line converter for transmitting signals transmitted through a waveguide packet with a dielectric to a microstrip line without signal transmission loss.

2. Description of the Prior Art

In microwave transmission systems, a waveguide and a microstrip line are employed in a transmission circuit. Accordingly, signals are often required to be transmitted from the waveguide to the microstrip line (in some cases, the reverse). Since the dominant mode of a general rectangular waveguide is TE mode while the mode of a microstrip liner is TEM mode, the waveguide and the microstrip line need to be connected through a mode converter for impedance matching.

A conventional waveguide-microstrip line converter is shown in FIG. 4, in which there are shown a short-circuit waveguide 21, a probe 22, a MIC substrate 23, a microstrip line 24, solder 25, a mount 26, screws 27, and a recess 28 formed in one wall of the short-circuit waveguide 21.

The metallic short-circuit waveguide 21 is hollow. The probe 22 is provided inside the metallic short-circuit waveguide 21 and is fixed at one end thereof to the short-circuit waveguide 21 with the screws 27 so that the other end thereof projects through the recess 28 outside the short-circuit waveguide 21. The probe 22 is soldered at the free end of the portion projecting from the short-circuit waveguide 21 by the solder 25 to the microstrip line 25 formed on the MIC substrate 23. The MIC substrate 23 and the short-circuit waveguide 21 are attached to the mount 26 to constitute a waveguide-microstrip line converter.

However, several problems have been encountered by the prior art waveguide-microstrip converter. One of the problems is that, since the probe 22 is fastened with the screws 27 to the surface of the short-circuit waveguide 21 carrying large surface current and the probe 22 is liable to be in incomplete contact with the short-circuit waveguide 21, the high frequency resistance across the joint of the probe 22 and the short-circuit waveguide 21 is large, and thereby signal transmission loss is increased. Another problem is that the screws 27 are liable to be loosened by vibration and hence the probe 22 is liable to be loosened, which also increases signal transmission loss.

SUMMARY OF THE INVENTION

In view of the foregoing problems of the conventional waveguide-microstrip line converter, it is an object of the present invention to provide a waveguide-microstrip line converter having a probe provided within a short-circuit waveguide packed with a dielectric so as to be held securely by the dielectric and formed integrally with the conductive layer formed over the surface of the short-circuit waveguide to reduce signal transmission loss by reducing high frequency resistance.

The object of the present invention is achieved by a waveguide-microstrip line converter comprising a dielectric body, a probe formed within the dielectric body so that one end thereof is exposed as a connecting part for connection to a microstrip line, and a conductive layer formed so as to be connected with the probe over the surface of the dielectric body excluding a surface thereof to be brought into contact with a waveguide and an area surrounding the connecting part of the probe. The dielectric body is connected to a waveguide and the probe is connected to a microstrip line for mode conversion.

In this waveguide-microstrip line converter of the present invention, since the probe is held securely by the dielectric, the probe is never vibrated and hence does not cause signal transmission loss. Moreover, since the probe is formed integrally with the conductive layer formed over the surface of the dielectric body, the probe and the short-circuit waveguide are interconnected surely and hence the high frequency resistance across the probe and the short-circuit waveguide is reduced.

The above and other objects, features and advantages of the present invention will become more apparent from the following description of the preferred embodiment thereof taken in conjunction with the accompanying drawings.

DESCRIPTION OF THE PREFERRED EMBODIMENT

Figure 1:
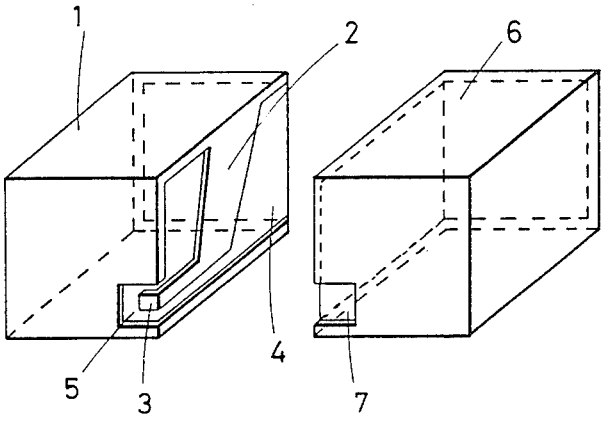
FIG. 1 is an exploded perspective view of a preferred embodiment of the present invention.
Figure 2:
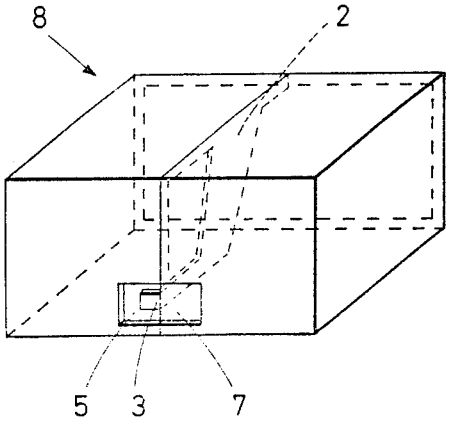
FIG. 2 is a perspective view of the embodiment of FIG. 1.

A preferred embodiment of the present invention will be described hereinafter with reference to FIGS. 1 to 3. In the drawings, there are shown dielectric blocks 1 and 6, a probe 2, a connecting part 3, uncoated areas 4, 5 and 7 of the dielectric blocks, and a short-circuit waveguide 8. A conductive layer is formed over the entire surfaces of the dielectric blocks 1 and 6 through plating or the like. Then, the dielectric block 1 is subjected to etching or the like to remove part of the conductive layer to provide the surface opposite the surface containing the connecting part 3 to be brought into contact with a waveguide, the uncoated area 4 in the surface in which the probe 2 is formed and the uncoated area 5 around the connecting part 3 of the probe 2 in the surface adjacent to the surface in which the probe 2 is formed. That is, the conductive layer formed over the surface to be brought into contact with a waveguide and the uncoated areas 4 and 5 are removed by etching to form the probe 2 and the connecting part 3. The probe 2 is continuous with the conductive layer formed over the surface of the dielectric block 1. On the other hand, the dielectric block 6 is also coated over the entire surface thereof with a conductive layer, and then part of the conductive layer corresponding to the surface to be brought into contact with a waveguide, the surface to be brought into contact with the probe 2 and the uncoated area 7 is removed through etching or the like. Then, the dielectric blocks 1 and 6 are joined together with the probe 2 therebetween to form a short-circuit waveguide 8 in the form of a single dielectric block. The short-circuit waveguide 8 and the probe 2 constitute a waveguide-microstrip line converter.

Figure 3:
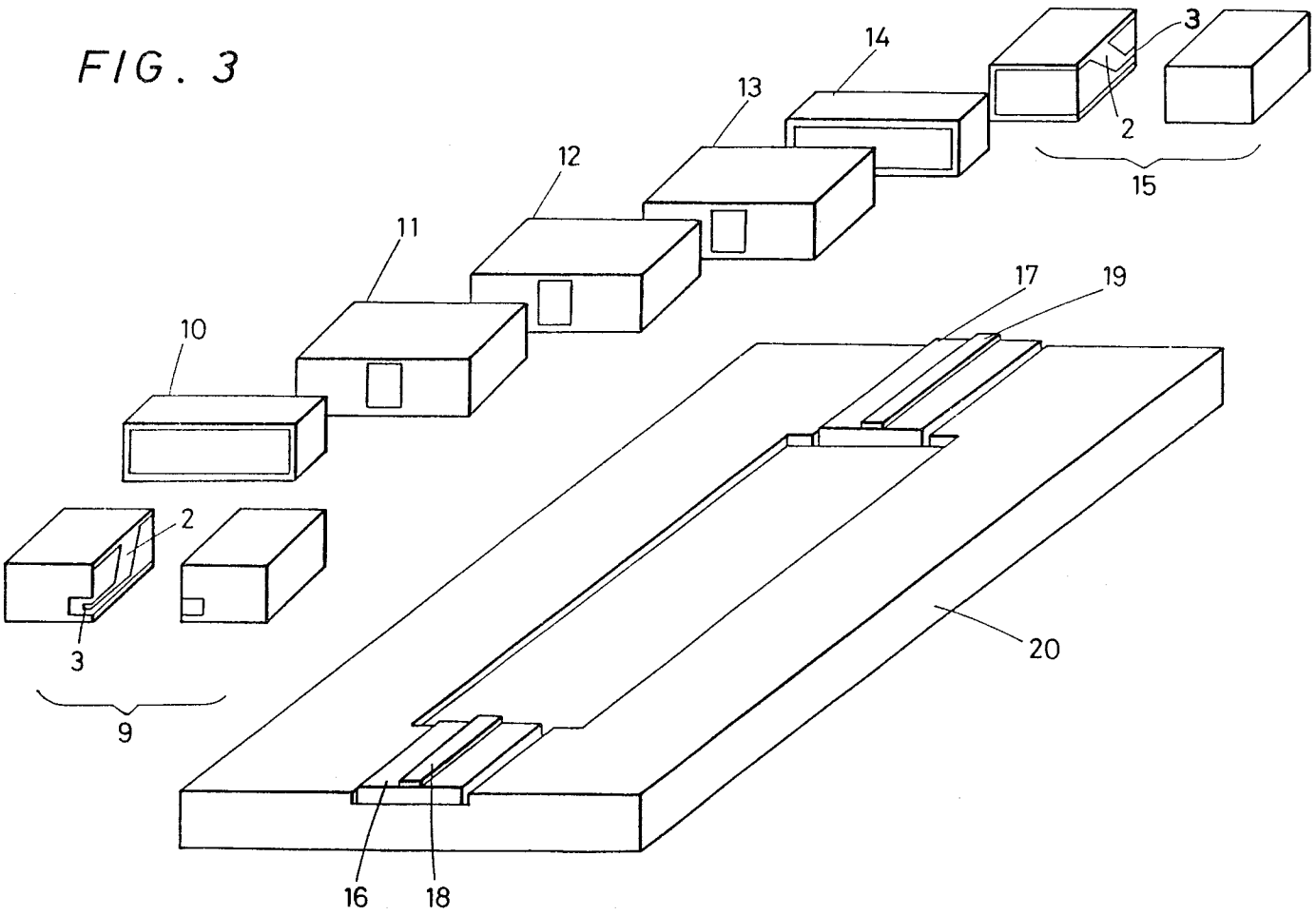
FIG. 3 is an exploded perspective view of a band-pass filter incorporating the waveguide-microstrip line converters of the present invention.
Figure 4:
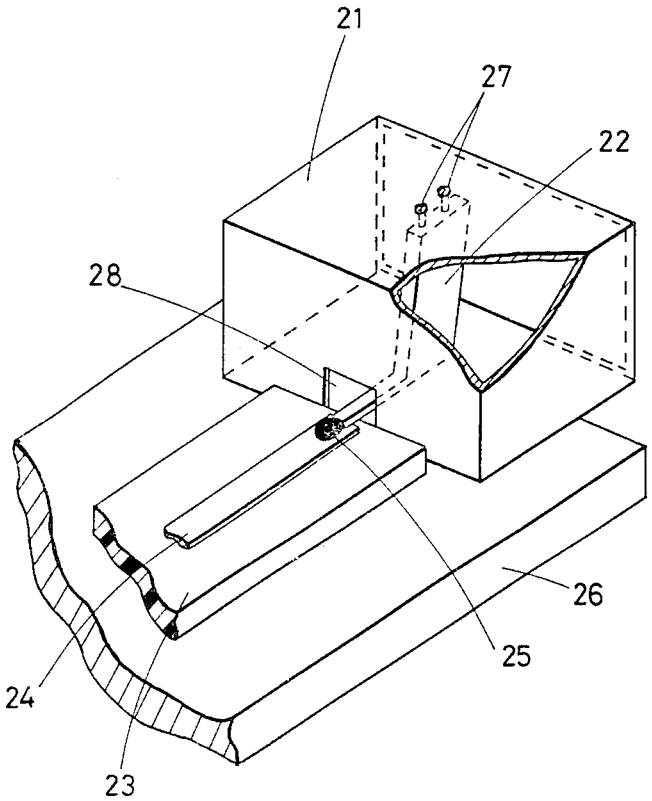
FIG. 4 PRIOR ART
FIG. 4 is a perspective view of a conventional waveguide-mirostrip line converter.

FIG. 3 illustrates an application of the waveguide-microstrip line converters of the present invention, by way of example, to a band-pass filter. Referring to FIG. 3, waveguide resonators 11, 12 and 13 packed with a dielectric are connected sequentially and waveguides 10 and 14 packed with a dielectric are disposed at the opposite ends of the array of the waveguide resonators 11, 12 and 13, respectively, to form a band-pass filter. The waveguide-microstrip line converters 9 and 15 are connected to the opposite ends of the band-pass filter, respectively. Then, the assembly of the band-pass filter and the waveguide-microstrip line converters 9 and 15 is mounted on a mount 20, and then the respective connecting parts 3 on the probes 2 of the waveguide-microstrip line converters 9 and 15 are soldered to microstrip lines 18 and 19 formed on MIC substrates 16 and 17, respectively.

As apparent from the foregoing description, since the probe is formed on one surface of a dielectric block and is held securely between the dielectric block and another dielectric block, the probe is mechanically stable and unaffected by vibration, and the performance of the probe is deteriorated scarcely by vibration and adverse actions, so that signal transmission loss is obviated. Furthermore, since the probe is formed integrally with the conductive layer formed over the surface of the short-circuit waveguide, the high frequency resistance across the probe and the short-circuit waveguide is reduced, and thereby signal transmission loss is obviated.

Although the invention has been described in its preferred form with a certain degree of particularity, it is to be understood by the skilled in the art that many changes and variations are possible in the invention without departing from the scope and spirit thereof.

What is claimed is:

1. A waveguide-microstrip line converter including a waveguide containing a probe supporting a connecting part exposed on an outer connecting side of the waveguide, wherein the connecting part is connected to a microstrip line, said converter comprising: said waveguide being comprised of two dielectric blocks which are joined together along their inner facing sides and, together, provide the outer connecting side on which the connecting part is connected to the microstrip line, each of said blocks being coated over its outer surface with a conductive layer, the conductive layer of a first one of said blocks being etched away on the inner facing side to form a clearance around a probe, which is formed as a continuation from the conductive layer, and etched on the outer connecting side to form a clearance around the connecting part, which is formed as a continuation of an end of the probe, and the second block being etched away on the inner facing side to form a clearance around the probe of the first block, and etched on the outer connecting side to form a clearance around the connecting part of the first block, whereby the probe is integrally held between the inner facing sides of the two joined dielectric blocks.

* * * * *